US012774424B2

(12) United States Patent
Dalal et al.

(10) Patent No.: US 12,774,424 B2
(45) Date of Patent: Oct. 27, 2026

(54) METHODS, APPARATUSES, AND SYSTEMS FOR CONVERSION OF BIO-ALCOHOLS TO RENEWABLE DIESEL

(71) Applicant: Honeywell International Inc., Charlotte, NC (US)

(72) Inventors: Vikrant Vilasrao Dalal, Haryana (IN); Akarsha Srivastava, Haryana (IN); Ankita Gupta, Haryana (IN); Arunim Bose, Haryana (IN); Gaurav Srivastava, Haryana (IN)

(73) Assignee: UOP LLC, Rosemont, IL (US)

( * ) Notice: Subject to any disclaimer, the term of this patent is extended or adjusted under 35 U.S.C. 154(b) by 85 days.

(21) Appl. No.: 18/429,615

(22) Filed: Feb. 1, 2024

(65) Prior Publication Data

US 2025/0250493 A1 Aug. 7, 2025

(51) Int. Cl.
*C10G 69/12* (2006.01)
*C10G 3/00* (2006.01)

(52) U.S. Cl.
CPC ..... *C10G 69/126* (2013.01); *C10G 3/60* (2013.01); *C10G 2300/4006* (2013.01); *C10G 2400/04* (2013.01)

(58) Field of Classification Search
CPC ..... C10G 69/126; C10G 3/60; C10G 2300/4006; C10G 2400/04; C10G 50/00; Y02E 50/10
See application file for complete search history.

(56) References Cited

U.S. PATENT DOCUMENTS 8,450,543 B2 5/2013 Peters et al.
8,552,241 B2 10/2013 Coupard et al.
(Continued)

FOREIGN PATENT DOCUMENTS

CN 107602349 A 1/2018

OTHER PUBLICATIONS

Agueda Constanza Villareal-Hernandez et al., "Intensification of the Oligomerization and Hydrogenation Stage for Biojet Fuel Production: Preliminary Outlines," Ind. Eng. Chem. Res., 62:8820-8833, (May 26, 2023).
(Continued)

*Primary Examiner* — Cephia D Toomer
(74) *Attorney, Agent, or Firm* — Paschall & Associates, LLC; James C. Paschall

(57) ABSTRACT

Methods, apparatuses, and systems for the conversion of bioalcohol to renewable diesel fuel are disclosed. In an example embodiment, a method includes providing a first bio-alcohol feed stream comprising a first bio-alcohol to a first dehydration reactor and providing a second bio-alcohol feed stream comprising a second bio-alcohol to a second dehydration reactor; dehydrating, in parallel, at least a portion of the first bio-alcohol feed stream to a first alkene process stream in the first dehydration reactor and at least a portion of the second bio-alcohol feed stream to a second alkene process stream in the second dehydration reactor; providing the first alkene process stream to an oligomerization reactor and oligomerizing at least a portion of the first alkene process stream to produce a first olefin process stream; providing the second alkene process stream from the second dehydration reactor to a dimerization reactor and dimerizing at least a portion of the second alkene process stream to produce a second olefin process stream; providing the first and second olefin process streams to a distillation apparatus and separating, via distillation, lighter olefins from longer carbon chain olefins; and hydrogenating at least a portion of the longer carbon chain olefins.

9 Claims, 7 Drawing Sheets

(56) References Cited

U.S. PATENT DOCUMENTS

| | | | | |
|---|---|---|---|---|
| 8,629,310 | B2 | 1/2014 | Lotero et al. | |
| 9,840,676 | B1 | 12/2017 | Harvey | |
| 11,639,320 | B1 | 5/2023 | Chang et al. | |
| 2012/0209043 | A1 | 8/2012 | Harvey et al. | |
| 2015/0045599 | A1* | 2/2015 | Frey | C07C 2/12 585/533 |
| 2017/0240925 | A1 | 8/2017 | Liang et al. | |
| 2023/0250039 | A1 | 8/2023 | Almering et al. | |
| 2023/0373883 | A1 | 11/2023 | Chang et al. | |

OTHER PUBLICATIONS

IPEA/408—Written Opinion of the IPEA Mailed on May 7, 2025 for WO Application No. PCT/US25/013589, 5 page(s).
Outgoing—ISA/210—International Search Report Mailed on May 7, 2025 for WO Application No. PCT/US25/013589, 3 page(s).

* cited by examiner

METHODS, APPARATUSES, AND SYSTEMS FOR CONVERSION OF BIO-ALCOHOLS TO RENEWABLE DIESEL

TECHNOLOGICAL FIELD

Example embodiments of the present disclosure relate generally to diesel fuel and, more particularly, to methods, apparatuses, and systems for the conversion of bio-alcohols to renewable diesel fuel.

BACKGROUND

The heavy-duty transport sector has come under increasing pressure to reduce its carbon footprint and minimize greenhouse gas emissions. Indeed, certain governmental policies may require or reward use of sustainable, biorenewable-sourced diesel fuel or diesel blending in order to decrease such carbon or greenhouse gas emissions. For example, to achieve India's decarbonization target of one billion metric tons (MT) reduction by 2030, the Indian government has administered an indicative 5% renewable diesel blending target in the diesel pool by 2030.

Applicant has identified a number of deficiencies and problems associated with conventional diesel fuel and conventional technologies for converting biorenewable sources to renewable ("REN") diesel fuel. Through applied effort, ingenuity, and innovation, many of these identified problems have been solved by developing solutions that are included in embodiments of the present disclosure, many examples of which are described in detail herein.

BRIEF SUMMARY

In general, example embodiments of the present disclosure provided herein may provide solutions to the problems and needs in the art that have not yet been fully identified, appreciated, or solved by current technologies for converting biorenewable sources to REN diesel fuel. In accordance with one exemplary embodiment of the present disclosure, a method for converting bioalcohol to renewable diesel fuel is disclosed, the method including providing a bio-alcohol feed stream to a dehydration reactor, wherein the bio-alcohol feed stream comprises bioisobutanol; dehydrating at least a portion of the bio-alcohol feed stream, thereby producing an alkene process stream; separating the alkene process stream into a first alkene process stream and a second process stream; oligomerizing the first alkene process stream into a first olefin process stream; dimerizing the second alkene process stream into a second olefin process stream; distilling the first and second olefin process streams, thereby separating a lighter olefin process stream from a heavier olefin process stream; and hydrogenating at least a portion of the contents of the heavier olefin process stream, thereby forming renewable diesel fuel In some embodiments, the bio-alcohol feed stream further comprises bioethanol. In other embodiments, the bio-alcohol feed stream consists of bioisobutanol.

In some embodiments, dehydrating at least the portion of the bio-alcohol feed stream is performed at a temperature of about 350-500° C.

In some embodiments, oligomerizing the first alkene process stream into the first olefin process stream 80-150° C.

In some embodiments, distilling the first and second olefin process streams is performed in a dual wall fractionator.

In some embodiments, the method further comprises withdrawing the lighter olefin process stream in an overhead stream from the dual wall fractionator and recycling the lighter olefin process stream into an oligomerization reactor.

In accordance with another exemplary embodiment of the present disclosure, a method for converting bioalcohol to renewable diesel fuel is disclosed, the method including providing a first bio-alcohol feed stream comprising a first bio-alcohol to a first dehydration reactor; providing a second bio-alcohol feed stream comprising a second bio-alcohol to a second dehydration reactor; dehydrating, in parallel, at least a portion of the first bio-alcohol feed stream to a first alkene process stream in the first dehydration reactor and at least a portion of the second bio-alcohol feed stream to a second alkene process stream in the second dehydration reactor; providing the first alkene process stream to an oligomerization reactor and oligomerizing at least a portion of the first alkene process stream to produce a first olefin process stream; providing the second alkene process stream from the second dehydration reactor to a dimerization reactor and dimerizing at least a portion of the second alkene process stream to produce a second olefin process stream; providing the first and second olefin process streams to a distillation apparatus and separating, via distillation, lighter olefins from longer carbon chain olefins; and hydrogenating at least a portion of the longer carbon chain olefins to produce a product stream comprising diesel fuel-range compatible hydrocarbons.

In some embodiments, the first bio-alcohol feed stream comprises bioisobutanol and the second bio-alcohol feed stream comprises bioethanol. In further embodiments, a sum of the first and second bio-alcohol feed streams is 50-99% bioisobutanol and 50-1% bioethanol. In certain embodiments, the sum of the first and second bio-alcohol feed streams is 50% bioisobutanol and 50% bioethanol.

In accordance with another exemplary embodiment of the present disclosure, a system for converting bioalcohol to renewable diesel fuel is disclosed, the system including a first dehydration reactor; a dimerization reactor; an oligomerization reactor; a dual wall fractionator; and a hydrogenation reactor.

In some embodiments, the system further comprises a low pressure splitter disposed downstream of the dehydration reactor and upstream of the dimerization reactor and the oligomerization reactor. In some further embodiments, the dimerization reactor and the oligomerization reactor are connected in parallel to the low pressure splitter such that the dimerization reactor is configured to receive a first process stream from the low pressure splitter and the oligomerization reactor is configured to receive a separate, second process stream from the low pressure splitter.

In some embodiments, the system further comprises a second dehydration reactor disposed in parallel to the first dehydration reactor. In some further embodiments, one or more logic-controlled valves are disposed between the first and second dehydration reactors, the one or more logic-controlled valves configured to open in the absence of two bio-alcohol feedstocks. In certain embodiments, the dimerization reactor is connected to the second dehydration reactor. In still further embodiments, the dimerization reactor is inaccessible to the first dehydration reactor.

In some embodiments, the one or more logic-controlled valves are configured to close in presence of two bio-alcohol feedstocks. In certain embodiments, the dual wall fractionator is configured to receive a first olefin process stream from the oligomerization reactor; and receive a second olefin process stream from the dimerization reactor in an instance wherein the one or more logic-controlled valves are closed.

BRIEF DESCRIPTION OF THE DRAWINGS

Having thus described the present disclosure in general terms, reference will now be made to the accompanying drawings, which are not necessarily drawn to scale. The components illustrated in the figures may or may not be present in certain embodiments described herein. Some embodiments may include fewer (or more) components than those shown in the figures.

Figure 1:
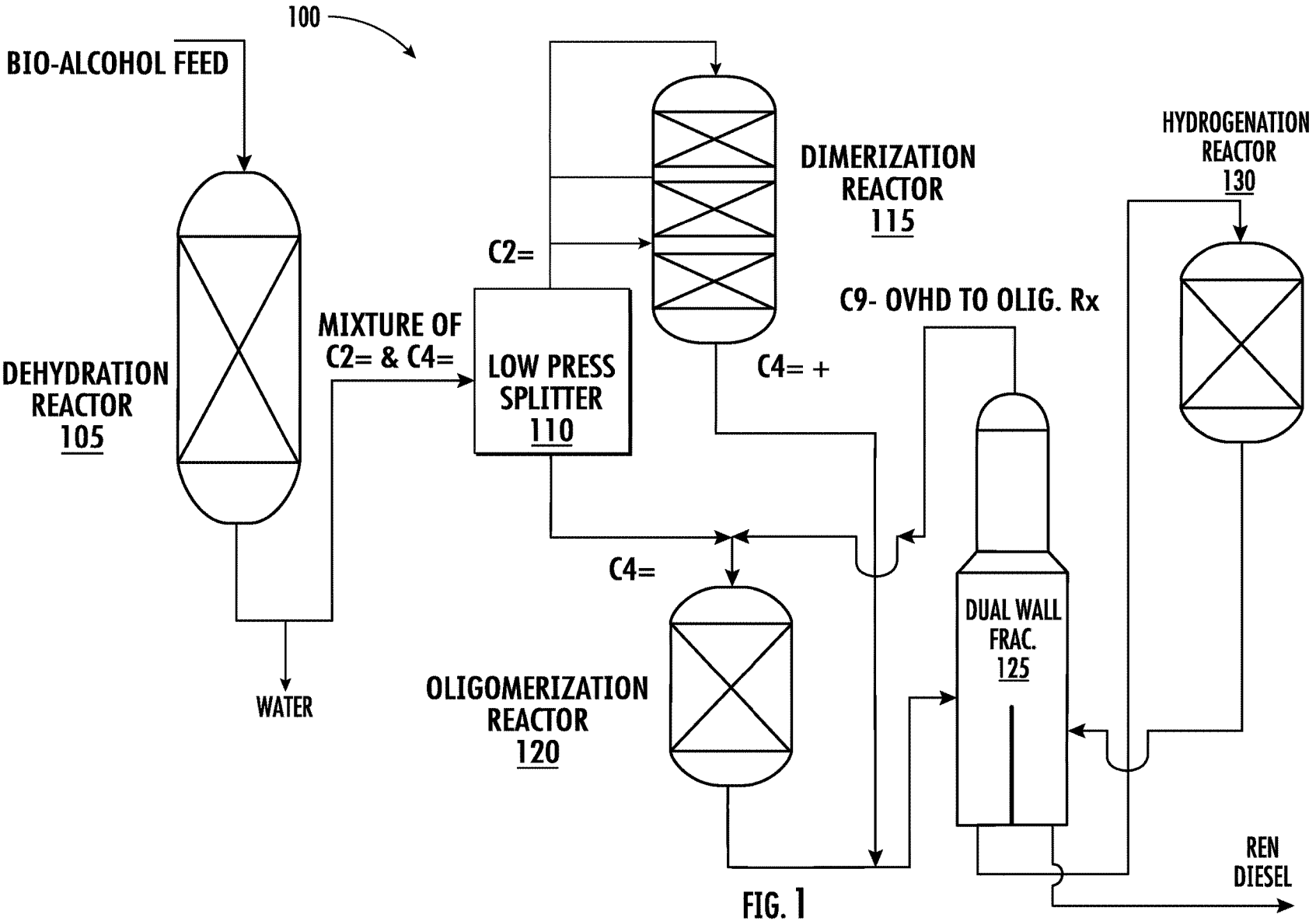

FIG. 1 illustrates a schematic representation of a system in accordance with some example embodiments described herein.

Figure 2:
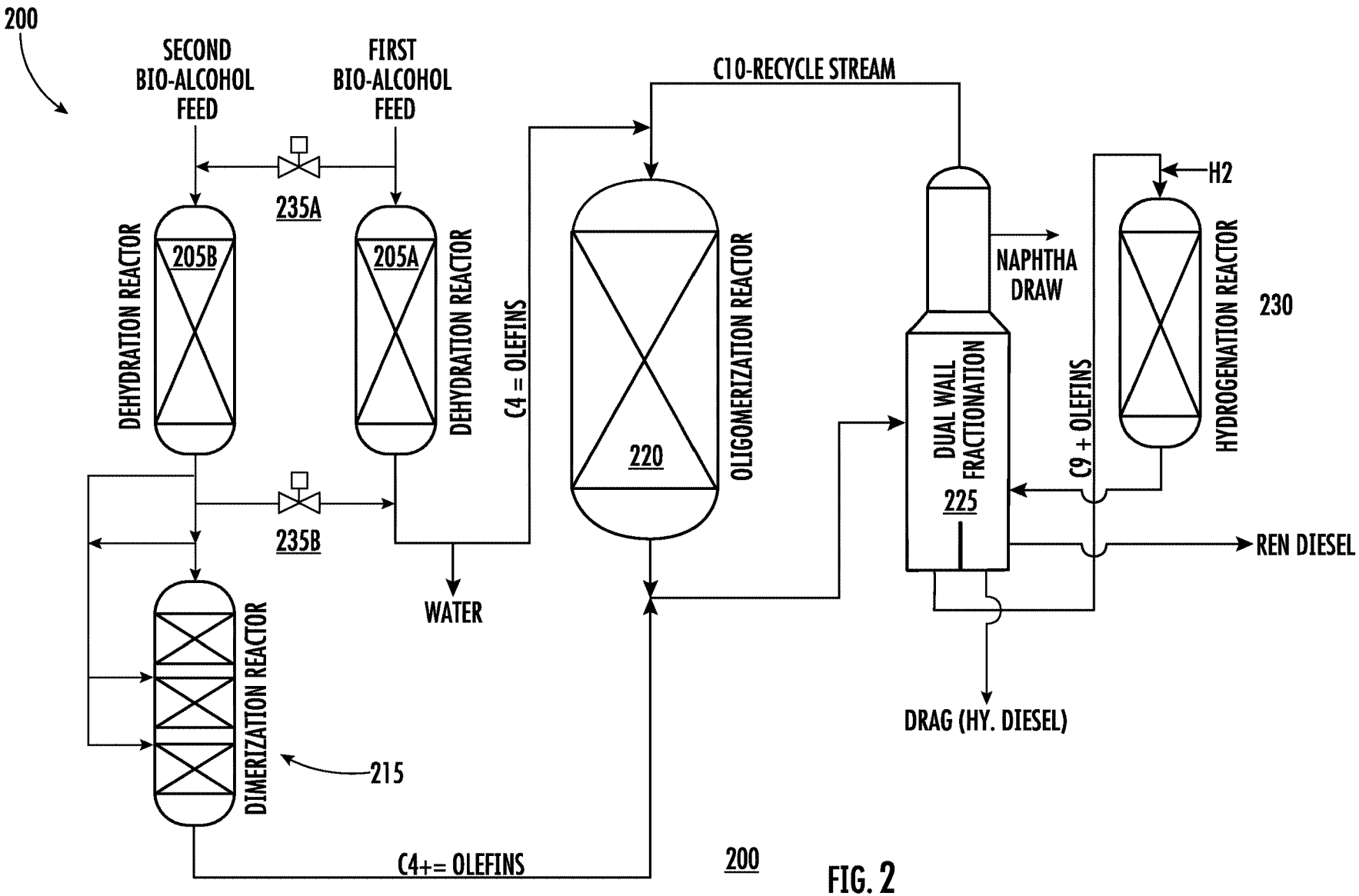

FIG. 2 illustrates a schematic representation of an alternative system in accordance with some example embodiments described herein.

Figure 3:
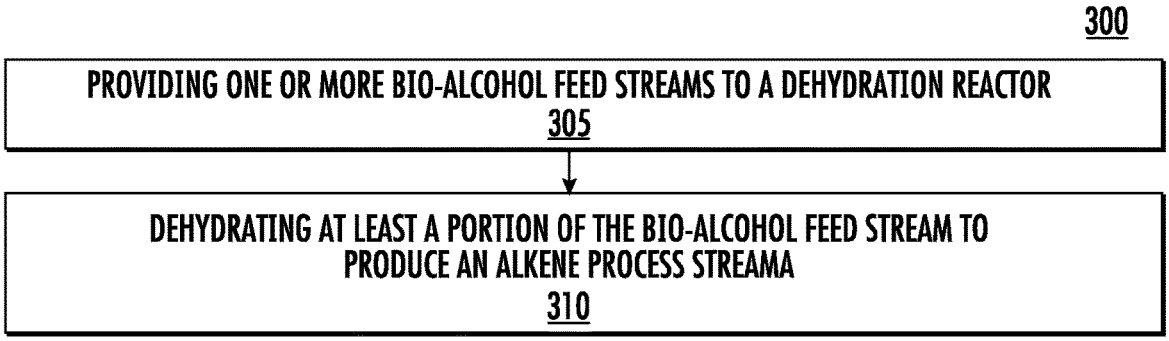

FIG. 3 illustrates an example flowchart for dehydrating bioalcohol(s) in a dehydration reactor in accordance with some example embodiments described herein.

Figure 4:
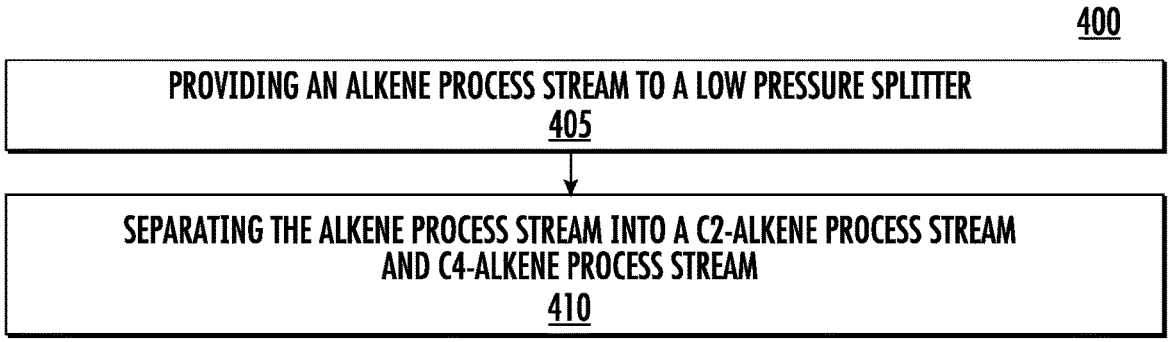

FIG. 4 illustrates an example flowchart for separating an ethylene process stream and isobutylene process stream via a low pressure splitter in accordance with some example embodiments described herein.

Figure 5:
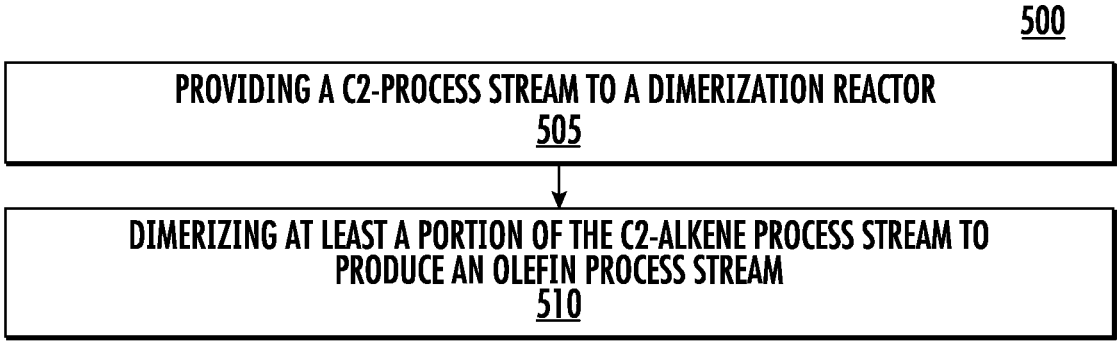

FIG. 5 illustrates an example flowchart for dimerizing an ethylene process stream in a dimerization reactor in accordance with some example embodiments described herein.

Figure 6:
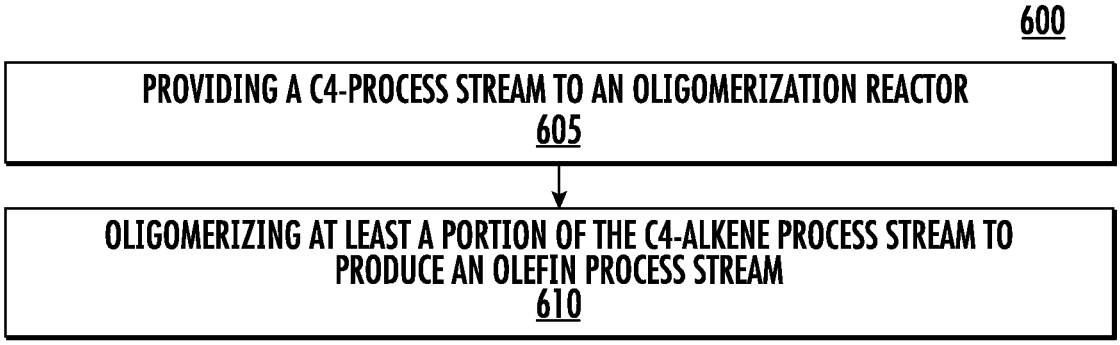

FIG. 6 illustrates an example flowchart for oligomerizing a butylene process stream in an oligomerization reactor in accordance with some example embodiments described herein.

Figure 7:
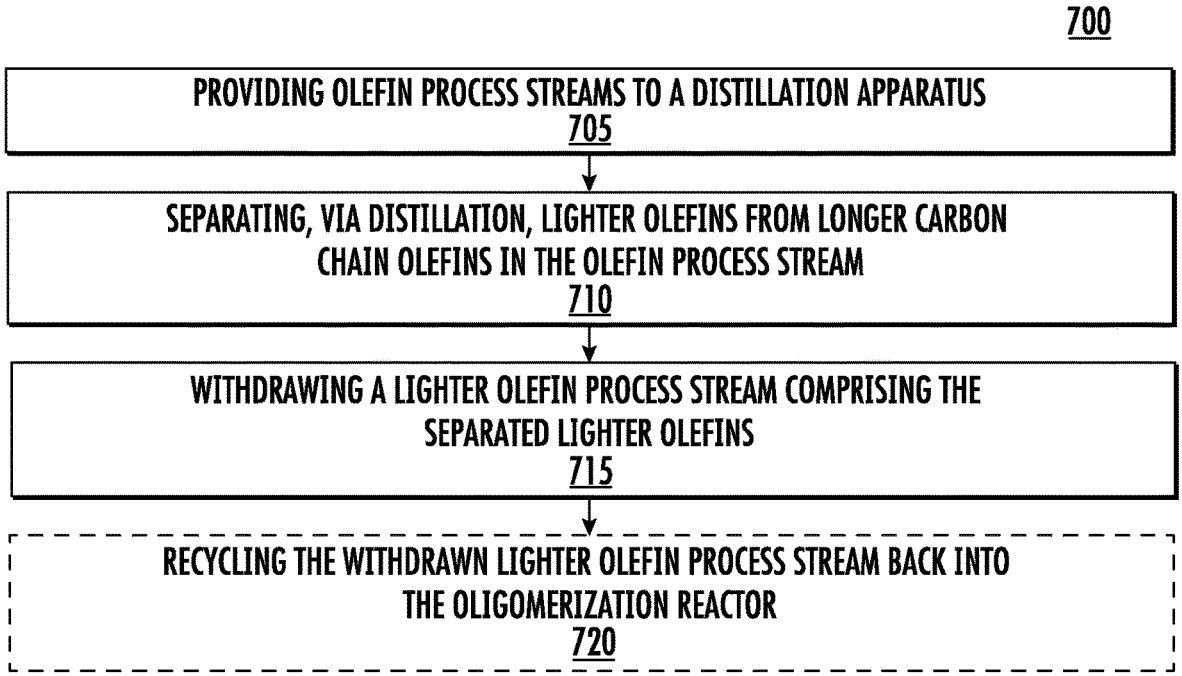

FIG. 7 illustrates an example flowchart for separating lighter and heavier olefins in a dual wall fractionator in accordance with some example embodiments described herein.

Figure 8:
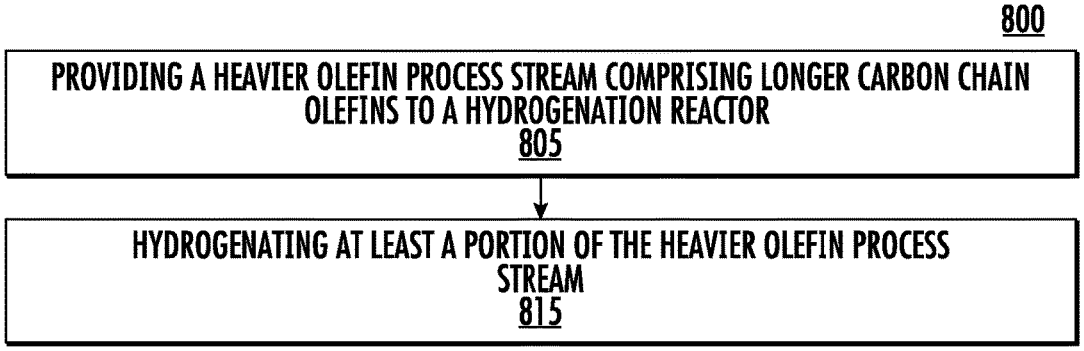

FIG. 8 illustrates an example flowchart for hydrogenating an oligomer process stream in a hydrogenation reaction zone in accordance with some example embodiments described herein.

Figure 9:
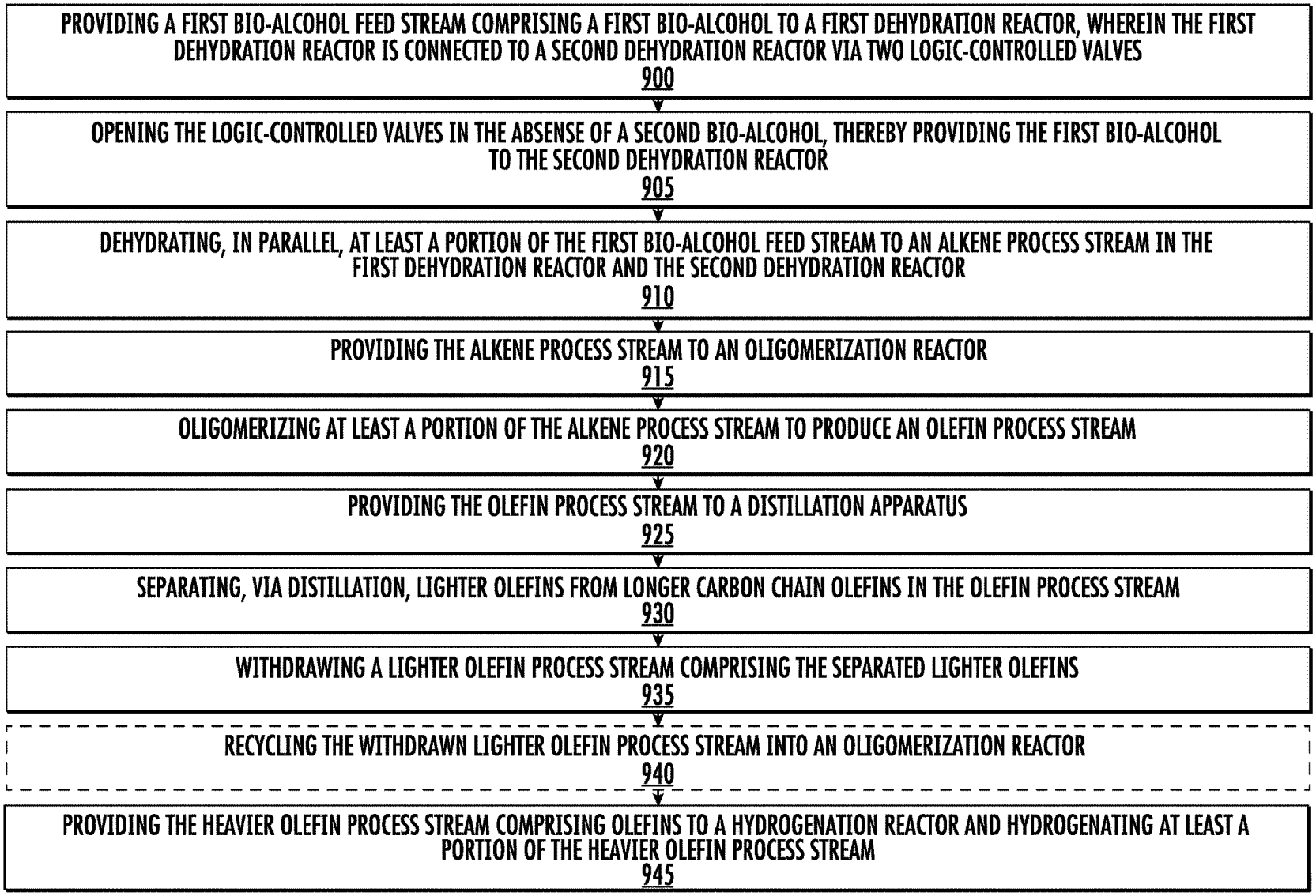

FIG. 9 illustrates an example flowchart for converting bioalcohol to renewable diesel fuel in accordance with some example embodiments described herein.

Figure 10:
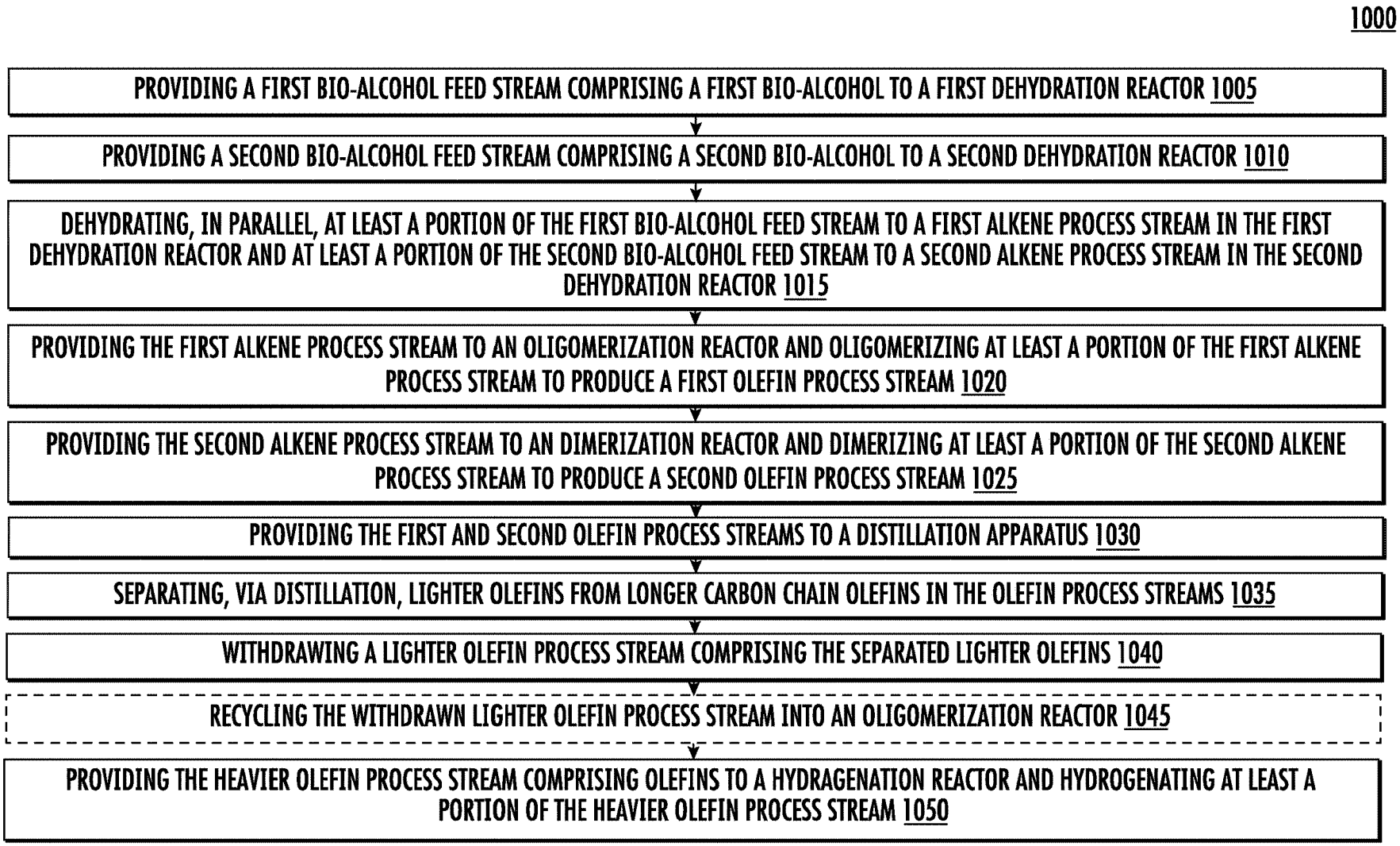

FIG. 10 illustrates another example flowchart for converting bioalcohol to renewable diesel fuel in accordance with some example embodiments described herein.

OVERVIEW

ASTM D975 (Grade 2D S15), entitled the "Standard Specification for Diesel Fuel", is the specification for commercial diesel fuel and dictates a flash point of 52° C. (Min) and ranges up to 56° C. for other grades of diesel. Hence, "as-is" adoption of ethanol in diesel poses constraints/limitations due to hitting the flash point. Renewable diesel fuel prepared from biorenewable sources (i.e., non-petroleum feedstocks), however, has similar properties to conventional diesel fuel but has a smaller carbon footprint for sustainability urgency and does not require any changes to heavy-duty transport technology or associated fuel infrastructure. That is, such renewable diesel fuel is a drop-in replacement for fossil diesel fuel.

Various embodiments of the present disclosure provide methods, apparatuses, and systems for the conversion of bio-alcohols to renewable diesel fuel. For example, bioethanol or cellulosic ethanol is an alcohol which can be made by fermenting plant-based carbohydrates. Bioethanol may be categorized as first (1G), second (2G), or third (3G) generation, based on the source of the materials used to manufacture the bioethanol. For example, 1G bioethanol may be produced from sugar- or starch-based edible feedstocks, such as corn seeds, sugar cane, and grains, 2G bioethanol may be produced from waste products (e.g., to avoid a food versus fuel dilemma), such as the inedible byproducts of food crops after harvest (e.g., rice husks, corn cobs, etc.), and 3G bioethanol may be produced by algae from waste water, sewage, or salt water. Currently, much of the bioethanol produced is blended with gasoline. Due to electric vehicle penetration, however, gasoline demand will decrease and surplus bio-ethanol and other bio-alcohols such as bio-iso-butanol will be available for production of renewable diesel fuel.

The inventors have determined it would be desirable and advantageous to be able to efficiently convert such bio-alcohol, regardless of source, to renewable diesel fuel in a commercial process, such that the hydrocarbon product of such process satisfies the various specifications as dictated by ASTM D975, "Standard Specification for Diesel Fuel". That is, along with bio-ethanol, the technology of the present disclosure is feedstock agnostic (feedstock flexible) for other bio-alcohols. Various embodiments of the present disclosure are feedstock sustainable (fuel vs. food scenario), enable a lean CAPEX and OPEX tailored for India investments, and otherwise reduce cost expenditures typically incurred in manufacturing such renewable diesel fuel.

Example embodiments of the present disclosure may convert bio-alcohols, such as a mixture of bioisobutanol and bioethanol, to renewable diesel fuel via a series of steps, including dehydration, separation, dimerization, oligomerization, fractional distillation, and mild hydrogenation. For example, in some embodiments, bioisobutanol ($C_4H_{10}O$) and bioethanol ($C_2H_5OH$) may be converted to isobutylene ($C_4H_8$) and ethylene ($C_2H_4$), respectively, via a dehydration step.

In another example embodiment, after separation, the resulting isobutylene may be oligomerized over an oligomerization catalyst into longer carbon chain olefins via an oligomerization step and the resulting ethylene may be dimerized over a dimerization catalyst via a dimerization step.

In still another example embodiment, the products of such oligomerization and dimerization reactions may be combined and subjected to a fractional distillation process in order to remove lighter olefins that have not formed, for example, at least C9-hydrocarbons from the system and/or recycled back into the oligomerization portion in order to be oligomerized into diesel fuel-compatible range and further maximize the conversion toward diesel fuel-compatible hydrocarbons.

In another example embodiment, the heavier or longer carbon chain olefins may be subjected to a mild hydrogenation process in order to saturate the olefinic components and form renewable diesel fuel.

The inventors have determined that embodiments of the present disclosure provide several advantages over conventional 100% bioethanol to renewable diesel flow schemes from which diesel fuel is produced and separated. For example, embodiments of the present disclosure provide improvements in C4-losses (delta reduction of ~1-2 wt %), unavoidable Naphtha byproduct C5 to 130° C. Cut (delta reduction of ~4-5 wt %), the heavy tail-end or diesel+ drag (delta reduction of ~1-2 wt %), and expected diesel yield (gain of ~5-7 wt % (carbon basis)). For example, due to effective molecular management in the production flow scheme of the present disclosure, such as via the separation and dimerization of ethylene to butylene, there is essentially no C2-hydrocarbons present in the Naphtha.

These characteristics as well as additional features, functions, and details are described below. Similarly, corresponding and additional embodiments are also described below.

DETAILED DESCRIPTION

Embodiments of the present disclosure now will be described more fully hereinafter with reference to the accompanying drawings. It should be understood that some, but not all embodiments are shown and described herein. Indeed, the embodiments may take many different forms, and accordingly, this disclosure should not be construed as limited to the embodiments set forth herein. Rather, these embodiments are provided so that this disclosure will satisfy applicable legal requirements. Like numbers refer to like elements throughout.

Example Systems and Apparatuses of the Disclosure

With reference to FIG. 1, an example system 100 according to one example embodiment is illustrated. In the depicted embodiment, the system 100 comprises at least a dehydration reactor 105, a low pressure splitter 110 downstream of the dehydration reactor 105, a dimerization reactor 115 and an oligomerization reactor 120 both downstream of the low pressure splitter 110, a dual wall fractionator downstream of the dimerization reactor 115 and the oligomerization reactor 120, and a hydrogenation reactor 130 downstream of the dual wall fractionator 125. The reactors may appropriately be interconnected to provide a continuous process.

As depicted in FIG. 1, the dehydration reactor 105 of system 100 comprises at least one inlet for receiving the bio-alcohol feedstock and an outlet connected to the low pressure splitter 110 for feeding an alkene process stream to the low pressure splitter 110. In turn, the low pressure splitter 110 comprises at least two outputs, a first output of the low pressure splitter 110 connected to the dimerization reactor 115 for feeding a C2-alkene process stream to an inlet of the dimerization reactor 115, and a second output of the low pressure splitter 110 connected to the oligomerization reactor 120 for feeding a C4-alkene process stream to an inlet of the oligomerization reactor 120. The dimerization reactor 115 comprises an outlet connected to the outlet of the oligomerization reactor 120 such that the outputs of the dimerization reactor 115 and the oligomerization reactor 120 are co-fed into a first inlet of the dual wall fractionator 125. In turn, the dual fractionator 125 comprises a top outlet connected to the oligomerization reactor 120 for optionally feeding/recycling separated lighter olefins (e.g., less than nine or ten carbon atoms) back into the oligomerization reactor 120 for further oligomerization and chain-lengthening. The dual wall fractionator 125 also comprises a second outlet connected to the hydrogenation reactor 130 for feeding heavier olefins to an inlet of the hydrogenation reactor 130 and converting such heavier olefins to their respective isoparaffins. The hydrogenation reactor 130 comprises an outlet for feeding the prepared isoparaffins back into a second outlet of the dual wall fractionator 125. The dual wall fractionator 125 further comprises a third outlet for removing the prepared isoparaffins as REN diesel.

With reference to FIG. 2, another example system 200 according to one example embodiment is illustrated. In the depicted embodiment, the system 200 comprises at least two dehydration reactors 205A, 205B, a dimerization reactor 215 downstream of dehydration reactor 205B, an oligomerization reactor 220 downstream of dehydration reactor 205A and the dimerization reactor 215, a dual wall fractionator 225 downstream of the dimerization reactor 215 and the oligomerization reactor 220, and a hydrogenation reactor 230 downstream of the dual wall fractionator 225. The reactors may appropriately be interconnected to provide a continuous process.

As depicted in FIG. 2, in a non-limiting example embodiment, the first dehydration reactor 205A is configured to receive a feedstock of 99%-50% of a first bio-alcohol, such as bio-isobutanol, and the second dehydration reactor 205B is configured to receive a feedstock of 1-50% of a second bio-alcohol, such as bioethanol. The dehydration reactors 205A, 205B may be connected via one or more valves 235A, 235B. For example, supply lines to and output lines from the dehydration reactors 205A, 205B may define such valves 235A, 235B. The first valve 235A may be disposed upstream of the dehydration reactors 205A, 205B, and configured to provide fluid communication between the dehydration reactors 205A, 205B in an open position and prevent fluid communication between the dehydration reactors 205, 205B in a closed position. The second valve 235B may be disposed downstream of the dehydration reactors 205A, 205B, and configured to provide fluid communication between the dehydration reactors 205A, 205B in an open position and prevent fluid communication between the dehydration reactors 205, 205B in a closed position.

In some embodiments, valves 235A, 235B may be logic-controlled valves 235A, 235B. In other words, the valves 235A, 235B may comprise, or be communicably coupled to, a controller, such as a programmable logic controller (PLC), the PLC configured to determine the presence or absence of a second bio-alcohol being supplied within the system in situ and result in a command to open or close the valves 235A, 235B in response thereto. For example, in some embodiments, the PLC (or the valves 235A, 235B including such a controller) may be communicably coupled to one or more sensors (not pictured), such as in-line sensor(s), positioned upstream in the supply lines to the dehydration reactors 205A, 205B. In doing so, such example implementations increase adjustability, optimize bio-alcohol feedstock usage, and minimize operating costs.

The controller (e.g., PLC) may include circuitry, processors, or the like configured to perform some or all of the processes (e.g., dynamic adjustment of the valves 235A, 235B) described herein, and may be any suitable type of processing device. In this regard, the controller may be embodied by any of a variety of devices. For example, the controller may be configured to receive and/or transmit data (e.g., sensor data) via one or more communication interfaces and input/output devices and may include one or more processors, transitive and non-transitive memories, and any other necessary computing hardware and software configured to perform the operations described herein. For example, the controller may be configured to execute instructions stored in a non-transitory, computer readable memory or otherwise accessible to one or more processors of the controller. Whether configured by hardware or by a combination of hardware with software, the controller may represent an entity capable of performing operations according to an embodiment of the present disclosure while configured accordingly.

In a first instance, for example, wherein at least some amount of a second bio-alcohol (e.g., 5% bioethanol) is used, the logic-controlled valves 235A, 235B are configured to remain closed, via the PLC, and prevent co-mingling of the feedstocks prior to dehydration and the alkene products subsequent to dehydration. In such examples, the bioisobutanol is fed to dehydration reactor 205A, wherein the bioisobutanol is converted to isobutylene and then the isobutylene is output from the dehydration reactor 205A and fed into the oligomerization reactor 220 where the isobutylene is converted to longer chain olefins. In such examples, the bioethanol is fed to dehydration reactor 205B, wherein the bioethanol is converted to ethylene and then the ethylene is output from the dehydration reactor 205B and fed into the dimerization reactor 215 wherein the ethylene is dimerized to butylene. The output of the dimerization reactor 215 is connected to connected to the outlet of the oligomerization reactor 220 such that the outputs of the dimerization reactor 215 and the oligomerization reactor 220 are co-fed into a first inlet of the dual wall fractionator 225.

In a second instance, for example, wherein a single bio-alcohol feedstock is used such as 100% of a first bio-alcohol (e.g., 100% bioisobutanol), the bioisobutanol is fed to dehydration reactor 205A, however, the valves 235A, 235B (e.g., logic-controlled valves) are configured to open, via the PLC, so that the dehydration reactor 205B (e.g., the dehydration reactor that was used for ethylene conversion in the first non-limiting example above) is available to receive (e.g., in fluid communication) the bioisobutanol and dehydrate the bioisobutanol in parallel with dehydration reactor 205A. In other words, the dehydration reactors 205A, 205B and the logic-controlledvalves 235A, 235B are configured to automatically adjust to a closed position or an open position swing with respect to two separate bio-alcohol feedstocks (e.g., bioethanol and bioisobutanol) and a single bio-alcohol feedstock (e.g., 100% bioisobutanol). In such instance, the converted alkene process stream, specifically, isobutylene, that is output from the dehydration reactors 205A, 205B is fed into the oligomerization reactor 220, thereby bypassing the dimerization reactor 215. In other words, the dimerization reactor 215 is only accessible when at least some amount of a second bio-alcohol (e.g., 1-50% bioethanol) is used as a feedstock.

Returning to the oligomerization reactor 220, the output of the oligomerization reactor 220 is fed into a first inlet of the dual wall fractionator 225. In turn, the dual fractionator 225 comprises a top outlet connected to the oligomerization reactor 220 for optionally feeding/recycling separated lighter olefins (e.g., less than nine or ten carbon atoms) back into the oligomerization reactor 220 for further oligomerization and chain-lengthening. The dual wall fractionator 225 also comprises a second outlet connected to the hydrogenation reactor 230 for feeding heavier olefins to an inlet of the hydrogenation reactor 230 and converting such heavier olefins to their respective isoparaffins. The hydrogenation reactor 230 comprises an outlet for feeding the prepared isoparaffins back into a second outlet of the dual wall fractionator 225. The dual wall fractionator 225 further comprises a third outlet for removing the prepared isoparaffins as REN diesel.

Example Methods

Referring to FIGS. 3-10, example methods of converting one or more bio-alcohols to renewable diesel fuel and for operating such conversion systems described herein are illustrated. That is, FIGS. 3-10 illustrate flowcharts containing series of steps for conducting an example bio-alcohol to renewable diesel fuel conversion, for example, with one of the systems 100, 200 as described above.

The Dehydration Step(s)

Although it is contemplated that the dehydration step may be conducted in batch operation, it is preferred that the dehydration reaction is carried out as a substantially continuous operation. While it is contemplated that the dehydration reaction may be conducted in a single reaction vessel, these reaction steps may comprise two or more reactors or reaction stages in parallel, in series, or both, or in any combination of reactor designs.

The dehydration reaction conditions are preferably controlled in the reaction in order to achieve the desired conversion and/or selectivity in accordance with the present disclosure. By way of example, but not by way of limitation, controlling or regulating any one or more of the following process parameters may achieve the desired conversion and/or selectivity: the temperature of the reaction, the flow rate of the reactants (e.g., incoming process stream(s)), the presence of a dehydration catalyst, the amount of catalyst present in the reaction vessel, the shape and size of the reaction vessel, the pressure of the reaction, and any combination(s) of these and other process parameters which will be available and known to those skilled in the art in view of the disclosure contained herein. For example, in some embodiments, the conditions of the dehydration reactor may be around 4 to 5 $kg/cm^2$ gauge pressure at one per hour WSV.

With reference to FIG. 3, in some example embodiments, example method 300 comprises providing one or more bio-alcohol feed streams to a dehydration reactor as depicted in step 305. For example, a bio-alcohol feed stream may comprise one or more bio-alcohols, such as biobutanol, bioisobutanol, bioethanol, biomethanol, biopropanol, or the like. That is, step 305 may be a feed flexible process step. In some embodiments, step 305 comprises providing a bio-alcohol feed stream comprising bioisobutanol. In certain embodiments, the bio-alcohol feed stream comprises 50-100% bioisobutanol. For example, in certain embodiments, the bio-alcohol feed stream may comprise 50%, 55%, 60%, 65%, 70%, 75%, 80%, 85%, 90%, 91%, 92%, 93%, 94%, 95%, 96%, 97%, 98%, 99%, or 100% bioisobutanol.

In some embodiments, bioisobutanol is co-fed into the dehydration reactor (e.g., dehydration reactor 105 of system 100) with at least a second bio-alcohol. For example, in some embodiments, the bio-alcohol feed stream comprises bioisobutanol and bioethanol. In certain embodiments, the bio-alcohol feed stream comprises 0-50% bioethanol. For example, in certain embodiments, the bio-alcohol feed stream may comprise 0%, 1%, 2%, 3%, 4%, 5%, 6%, 7%, 8%, 9%, 10%, 15%, 20%, 25%, 30%, 35%, 40%, 45%, or 50% bioethanol. In some embodiments, a first bio-alcohol feed stream may comprise bioisobutanol and a second bio-alcohol feed stream may comprise bioethanol and a sum of the co-fed bio-alcohol feed streams is 50-100% bioisobutanol and 0-50% bioethanol. For example, in a non-limiting example, the one or more bio-alcohol feed streams provided to the dehydration reactor comprise 50% bioisobutanol and 50% bioethanol. In some embodiments, the bioisobutanol is used as the main or majority bio-alcohol feedstock as it has an increased carbon density as compared to the bioethanol and may provide improved conversion results. For example, in a non-limiting example, the one or more bio-alcohol feed streams provided to the dehydration reactor comprise 95% bioisobutanol and 5% bioethanol. In another non-limiting example embodiments, the one or more bio-alcohol feed streams provided to the dehydration reactor comprise 100% bioisobutanol.

With continued reference to FIG. 3, example method 300 comprises dehydrating at least a portion of the bio-alcohol(s) of the bio-alcohol feed stream to produce an alkene process stream comprising unsaturated hydrocarbons as depicted in step 310. For example, in some embodiments wherein the bio-alcohol feed stream comprises bioisobutanol ($C_4H_{10}O$), at least a portion of the bioisobutanol is converted to isobutylene ($C_4H_8$) via step 310. In still further embodiments wherein the bio-alcohol feed stream comprises bioethanol ($C_2H_5OH$), at least a portion of the bioethanol is converted to ethylene ($C_2H_4$) via step 310. The bioalcohol(s) provided in step 305 may contain a substantial amount of water (e.g., almost 40%) and it may be necessary to reduce the amount of such water in order to efficiently and ultimately convert the bioalcohol(s) to renewable diesel fuel.

The respective olefins formed as a result of the dehydration in step 310 have different carbon densities depending on the feedstock. For example, isobutylene as prepared from bioisobutanol has a higher carbon density as compared to ethylene prepared from bioethanol. In such embodiments wherein bioisobutanol, alone or co-fed with bioethanol, is used in step 305, the resulting mass of isobutylene per meter cubed of the isobutanol fed into the dehydration reactor is approximately 26% higher, based on the carbon density, than compared to bioethanol used alone.

In addition, with bioisobutanol used as the sole or main feedstock in the present disclosure, the inventors have discovered the advantage and direct cost savings of being able to use a lower reaction temperature for dehydration. That is, embodiments of the present disclosure are able to perform the dehydration step (i.e., converting bioisobutanol to isobutylene) at a reaction temperature of around 75° C. lower than compared to dehydration of bioethanol or ethanol alone (i.e., bioethanol or ethanol to ethyelene). For example, wherein only bioethanol or ethanol are used in production of diesel, the conversion of bioethanol or ethanol to ethylene requires operating temperatures in the dehydration reactor 105 to be approximately 450° C. Embodiments of the present disclosure are able to perform the dehydration step at a reaction temperature of around 350-500° C.

In some embodiments, step 310 is performed in the presence of a dehydration catalyst. For example, the dehydration catalyst may include, but is not limited to, gamma alumina, gamma alumina chelated with citric acid, mixture of gamma alumina and lanthanum trioxide, or combinations thereof. In certain embodiments, the dehydration catalyst is gamma alumina. The dehydration catalyst may be selected to improve the selectivity and/or performance of the dehydration steps.

The Separation Step

Although it is contemplated that the separation step may be conducted in batch operation, it is preferred that the separation of the olefins is carried out as a substantially continuous operation. While it is contemplated that the separation step may be conducted in a single vessel, such as a low pressure splitter, the separation step may comprise two or more vessels or stages in parallel, in series, or both, or in any combination of splitter designs.

With reference to FIG. 4, in some example embodiments, example method 400 comprises providing an alkene process stream to a low pressure splitter as depicted in step 405. For example, in an instance wherein the feedstock of step 305 comprises a mixture of bioisobutanol and bioethanol, the mixture of isobutylene and ethylene formed in step 210 may be fed into a low pressure splitter (e.g., low pressure splitter 110 of system 100), thereby substantially separating the C2- and C4-alkenes (i.e., separating the isobutylene and ethylene) into separate process streams (e.g., C2-alkene process stream and C4-alkene process stream). That is, as depicted in step 410, example method 400 comprises separating the alkene process stream into at least two process streams. For example, step 410 may result in separation of the alkene process stream into a C2-alkene process stream and a C4-alkene process stream, wherein the C2-alkene process stream comprises C2-hydrocarbons comprising a double bond, such as ethylene, and the C4-alkene process stream comprises C4-hydrocarbons comprising a double bond, such as isobutylene. In some instances of the present disclosure, the C2-alkene process stream may be referred to as the ethylene process stream. In some instances of the present disclosure, the C4-alkene process stream may be referred to as the isobutylene stream, although other C4-alkene and olefins containing more than 4 carbons may be included in such isobutylene stream.

In some embodiments wherein only one bio-alcohol feedstock is used in method 300, such as 100% bioisobutanol, the separation process of example method 400 may not be necessary. For example, the alkene process stream containing the reaction product of the dehydration reaction of step 310 may comprise only isobutylene and, in some embodiments, such alkene process stream may be directly fed into a dimerization process, such as depicted in method 500, and/or an oligomerization process, such as depicted in method 600.

In some embodiments, the C2-alkene process stream comprising C2-alkenes (i.e., ethylene) may be subjected to a dimerization process (e.g., fed into a dimerization reactor), such as described herein in more detail with respect to method 500. In some embodiments, the C4-alkene process stream comprising C4-alkenes (i.e., isobutylene) may be subjected to an oligomerization process (e.g., fed into an oligomerization reactor), such as described herein in more detail with respect to method 600.

Although a low pressure splitter 110 is depicted in system 100 for the separation of C2-alkenes from C4-alkenes (e.g., ethylene from isobutylene), other apparatuses configured for the separation of such alkenes are suitable and contemplated by the present disclosure.

The Dimerization Step

Although it is contemplated that the dimerization step may be conducted in batch operation, it is preferred that the oligomerization reaction is carried out as a substantially continuous operation. While it is contemplated that the dimerization reaction may be conducted in a single reaction vessel, this reaction step may comprise two or more reactors or reaction stages in parallel, in series, or both, or in any combination of reactor designs.

The dimerization reaction conditions are preferably controlled in the system in order to achieve the desired conversion and/or selectivity in accordance with the present disclosure. For example, but not by way of limitation, controlling or regulating any one or more of the following process parameters may achieve the desired conversion and/or selectivity: the temperature of the reaction, the flow rate of the reactants (e.g., incoming process stream), the presence of an dimerization catalyst, the amount of catalyst present in the15imerizan vessel, the shape and size of the reaction vessel, the type of dimerization reactor (e.g., single-feed vs. multi-feed injection), the pressure of the reaction, and any combination(s) of these and other process parameters which will be available and known to those skilled in the art in view of the disclosure contained herein.

With reference to FIG. 5, in some example embodiments, example method 500 comprises providing a C2-alkene process stream to a dimerization reactor as depicted in step 505. For example, the C2-alkene process stream (e.g., comprising ethylene) separated from the alkene process stream (e.g., isobutylene and ethylene mixture) in step 405 and exiting the low pressure splitter 110 may be fed into a dimerization reactor (e.g., dimerization reactor 115 of system 100).

The dimerization reaction is highly exothermic. Accordingly, in some embodiments, the dimerization reactor 115 comprises a multi-feed injection into the dimerization reactor 115. Such a multi-feed injection into the dimerization reactor 115 enables control of the exotherm within each catalyst bed, rather than trying to process the entire feed into the dimerization reactor 115 from the top. Moreover, such multi-fee injection dimerization reactor 115 reduces or removes the requirement for a diluent to control the exotherm. Such multi-feed injection splits the incoming feed into multiple injections at the inlet of each bed in the dimerization reactor 115, thereby controlling the exotherm and acting as an interbed quench.

With continued reference to FIG. 5, example method 500 comprises dimerizing at least a portion of the C2-alkene process stream to produce a process stream comprising butylene ($C_4H_8$) or other C4 or greater-olefins (e.g., C4-C8 olefins) as depicted in step 510. For example, ethylene ($C_2H_4$) is a C2-alkene and dimerizes to butylene ($C_4H_8$), a C4-alkene.

In some embodiments, step 510 is performed in the presence of a dimerization catalyst.

In some embodiments, the conversion of the C2-alkenes to C4-alkenes and/or C4-plus olefins in step 510 is greater than 90%. For example, in certain examples, the conversion of ethylene (e.g., C2-alkene) to butylene (e.g., C4-alkene) in step 410 is 91%, 92%, 93%, 94%, 95%, 96%, 97%, 98%, 99%, or 100%. That is, in some embodiments, the outcome of step 410 may be 100% or near 100% conversion of ethylene to butylene or butylene-plus (i.e., C4-alkene and/or C4-plus olefins). It is contemplated by this disclosure that there may some C2-alkenes still present in the process stream exiting the dimerization reactor 115, however, it is expected that such presence will be minimal, if any.

In some embodiments, the product of step 510 (e.g., the output of the dimerization reactor 115) may be subjected to a fractional distillation process (e.g., fed into a dual-wall fractionator 125), such as described herein in more detail in method 700. In some certain embodiments, the product of step 510 (e.g., the output of the dimerization reactor 115) is combined with the product of step 610 (e.g., the output of the oligomerization reactor 120), as described herein below, prior to being fed into a dual-wall fractionator 125.

The Oligomerization Steps

Although it is contemplated that the oligomerization steps may be conducted in batch operation, it is preferred that the oligomerization reaction is carried out as a substantially continuous operation. While it is contemplated that the oligomerization reaction may be conducted in a single reaction vessel, these reaction steps may comprise two or more reactors or reaction stages in parallel, in series, or both, or in any combination of reactor designs.

The oligomerization reaction conditions are preferably controlled in the reaction in order to achieve the desired conversion and/or selectivity in accordance with the present disclosure. For example, but not by way of limitation, controlling or regulating any one or more of the following process parameters may achieve the desired conversion and/or selectivity: the temperature of the reaction, the flow rate of the reactants (e.g., incoming process stream), the flow rate of unconverted or C9 or lighter olefins recycle, the presence of an oligomerization catalyst, the amount of catalyst present in the reaction vessel, the shape and size of the reaction vessel, the pressure of the reaction, and any combination(s) of these and other process parameters which will be available and known to those skilled in the art in view of the disclosure contained herein.

With reference to FIG. 6, in some example embodiments, example method 600 comprises providing a C4-alkene process stream to an oligomerization reactor as depicted in step 605. For example, the C4-alkene process stream (e.g., comprising isobutylene, butylene, and/or other C4-alkenes or olefins with greater than 4 carbon atoms) separated from the alkene process stream (e.g., isobutylene and ethylene mixture) in step 405 and exiting the low pressure splitter 110 may be fed into an oligomerization reactor (e.g., oligomerization reactor 120 of system 100).

With continued reference to FIG. 6, example method 600 comprises oligomerizing at least a portion of the C4-alkene process stream to produce an olefin process stream as depicted in step 610. For example, at least a portion of the C4-alkene process stream (e.g., comprising C4-hydrocarbons with one or more double bonds, such as isobutylene) may be converted to at least C8−, C10−, C12−, C14−, C16−, and/or C16+− hydrocarbons (e.g., C8-C16+ hydrocarbons but avoiding heavier or "drag" diesel hydrocarbons such as C24+-hydrocarbons which may not quality for renewable diesel fuel criteria) in the olefin process stream. In an embodiment wherein the C4-alkene process stream is received from a low pressure splitter 110, as depicted in system 100, the inventors have determined that since the incoming feed is controlled (e.g., ethylene was previously separated from the isobutylene and other C4-alkenes), the conversion of the C4-alkenes (e.g., isobutylene) need not compete with the conversion of C2-alkenes (e.g., ethylene) due to the prior separation and a more precisely-controlled higher chain molecule exits the oligomerization reactor 120 (as compared to an oligomerization reaction with both ethylene and isobutylene present).

In addition, in embodiments wherein bioisobutanol is used as the sole or main feedstock in the present disclosure, the inventors have discovered the advantage and direct cost savings of being able to use a lower reaction temperature for oligomerization. That is, embodiments of the present disclosure are able to perform the oligomerization step (i.e., converting isobutylene to longer chains) at a reaction temperature of around 100° C. lower than compared to oligomerization of ethylene. For example, wherein only bioethanol or ethanol are used as the feedstock in the production of diesel, the conversion of ethylene to longer chain olefins in the oligomerization reactor 120 requires operating temperatures in the oligomerization reactor 120 to be approximately 210-250° C. Here, embodiments of the present disclosure are able to perform the oligomerization step at a reaction temperature of around 80-150° C. due to inclusion of bioisobutanol as a feedstock and separation of the butylene and ethylene products prior to oligomerization.

In some embodiments, step 610 is performed in the presence of an oligomerization catalyst. For example, the oligomerization catalyst may include, but is not limited to, zeolite base solid acid catalysts with alumina/silica binders, such as ZSM 23, ZSM 24, and similar family, or combinations thereof.

In some embodiments, the product of step 610 (e.g., the output of the oligomerization reactor 120) may be subjected to a fractional distillation process (e.g., fed into a dual-wall fractionator 125), such as described herein in more detail in method 600. In some certain embodiments, the product of step 610 (e.g., the output of the oligomerization reactor 120) is combined with the product of step 410 (e.g., the output of the19imerizationn reactor 115) prior to being fed into a dual-wall fractionator 125.

By not thereafter subjecting the oligomerized product output of the oligomerization reactor 120 (e.g., C8-C16+-hydrocarbons) to a dimerization reactor 115, the production of heavy or "drag" diesel hydrocarbons, such as C24+, which will not quality for renewable diesel criteria, can be reduced.

The Fractional Distillation Step

Although it is contemplated that the fractional distillation steps may be conducted in batch operation, it is preferred that the fractional distillation reaction is carried out as a substantially continuous operation. While it is contemplated that the fractional distillation reaction may be conducted in a single reaction vessel, these reaction steps may comprise two or more reactors or reaction stages in parallel, in series, or both, or in any combination of reactor designs.

With reference to FIG. 7, in some example embodiments, example method 700 comprises providing a process stream comprising butylene ($C_4H_8$) or other C4 or greater-olefins (e.g., C4-C8 olefins) and/or an olefin process stream to a distillation apparatus, such as a dual wall fractionator, as depicted in step 705. For example, in some embodiments, the process stream exiting the dimerization reactor 115 in step 510 (which comprises butylene ($C_4H_8$) or other C4 or greater-olefins (e.g., C4-C8 olefins)) and the olefin process stream exiting the oligomerization reactor 120 in step 610 may be fed into a dual wall fractionator (e.g., dual wall fractionator 125 of system 100).

With continued reference to FIG. 7, method 700 includes separating, via distillation, lighter olefins from longer carbon chain olefins in the received process stream(s), as depicted in step 710. For example, heavier olefins or longer carbon chain olefins are olefins having nine or more carbon atoms, while lighter olefins may be unconverted olefins having less than nine carbon atoms or converted olefins that continue to have less than nine carbon atoms. Instead of allowing such lighter olefins (e.g., having less than nine carbon atoms) from proceeding through the main process stream of the system 100, the process streams of step 705 are subjected to a distillation process in a distillation apparatus, such as the dual wall fractionator 125, which is configured to distill and separate a fraction comprising (e.g., enriched in) such lighter olefins from a fraction comprising the heavier olefins. Although a dual wall fractionator 125 is depicted in system 100 for the fractional distillation separation of such lighter olefins (e.g., olefins with less than nine carbon atoms), other apparatuses configured for the distillative separation of reaction mixtures are suitable and contemplated by the present disclosure. The distillation apparatus may comprise one or more distillation columns or towers to accomplish the separation of such lighter olefins from the product stream.

In some embodiments, such fractional distillation may be used to separate a fraction comprising lighter olefins from the main process stream (e.g., olefins with nine or more carbon atoms) of the system 100. Removal of such lighter olefins (e.g., olefins with less than nine carbon atoms) from the main process stream of the system 100 may reduce operating costs and lead to improved efficiency. In some embodiments, substantially all of the lighter olefins may be separated from the main process stream, however, it is contemplated by the present disclosure that minor amounts of the lighter olefins may remain in the main process stream and/or minor amounts of other components (e.g., by-productions, heavier olefins, and/or the like) may be separated with the lighter olefins. For example, the overhead fraction separated by fractional distillation in step 710 may contain about 90 to 100% by weight, preferably 95 to 99% by weight, of lighter olefins (e.g., having less than nine carbon atoms), based on a total weight of the separated process stream. Although lighter olefins and the overhead fraction are described herein as having less than nine carbon atoms, it is also contemplated by this disclosure that such fractional distillation can be configured to separate lighter olefins having less than ten carbon atoms.

As depicted in system 100, the lighter olefins (e.g., having less than nine carbon atoms) may be withdrawn or removed from the top of the dual-wall fractionator 125. For example, with continued reference to FIG. 7, method 700 includes withdrawing a lighter olefin process stream comprising the separated lighter olefins as depicted in step 715. For example, step 715 may comprise withdrawing an overhead stream from the top of the dual-wall fractionator 125, wherein the overhead stream comprises separated lighter olefins.

Method 700 may optionally further include recycling the withdrawn lighter olefin process stream into the oligomerization reactor (e.g., oligomerization reactor 120) as depicted in step 720. Such recycling back into the oligomerization reactor 120 advantageously enables further oligomerization of such lighter olefins into diesel fuel-compatible range (e.g., diesel-fuel boiling range) which may further maximize the conversion toward diesel fuel-compatible hydrocarbons (e.g., predominantly C12+ and C16+ carbon range) and reduce the need to remove a large amount of "drag" or unavoidable light Naphtha byproduct (e.g., C9- or C11-hydrocarbons which cannot meet the renewable diesel fuel minimum flashpoint of 52° C.).

In some embodiments, the remaining olefins (e.g., having nine carbon atoms or more) in the process streams provided to the dual wall fractionator may be removed from the bottom (e.g., left side portion) of the dual wall fractionator via a bottom stream as depicted in system 100 of FIG. 1. For example, the bottom stream may comprise a heavier olefin process stream (e.g., such olefins having nine carbon atoms or more).

The heavier olefins (e.g., remaining olefins having nine carbon atoms or more) of the heavier olefin stream may be subjected to a mild hydrogenation process as described in detail herein with respect to method 800 and FIG. 8 in order to convert such heavier olefins to their respective isoparaffins (i.e., isoparaffin process stream).

The Hydrogenation Step

In some example embodiments, the heavier olefin process stream comprising such olefins having nine carbon atoms or more that is exiting the distillation apparatus of method 700 may be subjected to a mild hydrogenation process in order to reduce the olefinic components and produce saturated hydrocarbons (e.g., isoparaffins which are branched-chains of saturated hydrocarbons). Although it is contemplated that the hydrogenation step may be conducted in batch operation, it is preferred that the hydrogenation reaction is carried out as a substantially continuous operation. While it is contemplated that the hydrogenation reaction may be conducted in a single reaction vessel, this reaction step may comprise two or more reactors or reaction stages in parallel, in series, or both, or any combination of reactor designs.

The hydrogenation reaction conditions are preferably controlled in the reaction in order to achieve the desired conversion and/or selectivity in accordance with the present disclosure. By way of example, but not by way of limitation, controlling or regulating any one or more of the following process parameters may achieve the desired conversion and/or selectivity: the temperature of the reaction, the flow rate of the reactants (e.g., incoming process stream), the presence of a hydrogenation catalyst, the amount of catalyst present in the reaction vessel, the shape and size of the reaction vessel, the pressure of the reaction, and any combination(s) of these and other process parameters which will be available and known to those skilled in the art in view of the disclosure contained herein.

With reference to FIG. 8, in one embodiment, example method 800 may include providing the heavier olefin process stream comprising the longer carbon chain olefins to a hydrogenation reactor as depicted in step 805. For example, in some embodiments, the hydrogenation reactor (e.g., hydrogenation reactor 130, 230) receives the heavier olefin process stream from the dual wall fractionator 125, 225 as prepared in method 700. In some embodiments, the dual wall fractionator 125, 225 may be disposed upstream of the hydrogenation reactor 130, 230. In a preferred embodiment, the heavier olefin process stream comprises a majority of longer carbon chain olefins (e.g., greater than nine carbon atoms).

With continued reference to FIG. 8, example method 800 comprises hydrogenating, in the hydrogenation reactor (e.g., hydrogenation reactor 130, 230) at least a portion of the heavier olefin process stream to produce a product stream comprising diesel fuel-range compatible hydrocarbons as depicted in step 810. For example, the longer carbon chain olefins as separated in the dual wall fractionator 125, 225 as depicted in method 700 may be subjected to a mild hydrogenation process in order to reduce the olefinic components and produce high-value saturated hydrocarbons (e.g., C9-C16+ hydrocarbons).

In some embodiments, the conversion of the heavier olefins (e.g., C9+ olefins) of the heavier olefin process stream to isoparaffins via mild hydrogenation in step 810 is greater than 90%. For example, in certain examples, the conversion to isoparaffins in step 710 is 91%, 92%, 93%, 94%, 95%, 96%, 97%, 98%, 99%, or 100%. That is, in some embodiments, the outcome of step 710 may be 100% or near 100% conversion of the heavier olefins to their respective isoparaffins.

In some embodiments, step 810 is performed in the presence of a hydrogenation catalyst. For example, the hydrogenation catalyst may include, but is not limited to, metallic catalysts containing, e.g., palladium, rhodium, nickel, ruthenium, platinum, rhenium, cobalt, molybdenum, or combinations thereof, and the supported versions thereof, platinum (e.g., ranging 0.2 to 1 wt %) on alumina, amorphous silica alumina, nickel on alumina, and mixtures thereof, or combinations thereof. Such hydrogenation catalyst(s) may be selected to maximize isomerization and further increase an iso-to-normal ratio of the C9-C16+ hydrocarbons in order to enhance properties of the resulting renewable diesel fuel.

After such mild hydrogenation, such resulting isoparaffins (i.e., isoparaffin process stream) may be fed back into the dual wall fractionator 125, 225. For example, the isoparaffin process stream may be fed into the side (e.g., right side so no intermixing of the isoparaffin process stream with the olefin process stream(s)) of the dual wall fractionator as depicted in system 100 in FIG. 1. The product (i.e., isoparaffin product stream) may then be removed from the dual wall fractionator 125, 225/system 100, 200 as it meets the specifications of renewable diesel fuel in terms of its cloud point, cold flow properties, and other aspects.

In an alternative embodiment, such as an embodiment utilizing the system 200 with two dehydration reactors 205A, 205B and logic-controlled valves 235A, 235B, the methods 900, 1000 for converting bioalcohol(s) to renewable diesel fuel are similar to the methods described with respect to FIGS. 3-8 such that the disclosures related thereto are not repeated here. For example, the dehydration portion of method 900 is similar to method 300 in that dehydration reaction conditions are preferably controlled in the reaction(s) in order to achieve the desired conversion and/or selectivity in accordance with the present disclosure. By way of example, but not by way of limitation, controlling or regulating any one or more of the following process parameters may achieve the desired conversion and/or selectivity: the temperature of the reaction, the flow rate of the reactants (e.g., incoming process stream(s)), the presence of a dehydration catalyst, the amount of catalyst present in the reaction vessel(s), the shape and size of the reaction vessel(s), the pressure of the reaction(s), and any combination(s) of these and other process parameters which will be available and known to those skilled in the art in view of the disclosure contained herein.

With reference to FIG. 9, in some example embodiments, example method 900 comprises providing a first bio-alcohol feed stream comprising a first bio-alcohol to a first dehydration reactor, wherein the first dehydration reactor is connected to a second dehydration reactor via two logic-controlled valves, as depicted in step 905. For example, the first bio-alcohol feed stream may comprise bioisobutanol. In certain embodiments, the first bio-alcohol feed stream comprises 100% bioisobutanol. As depicted in system 200 in FIG. 2, a first logic-controlled valve 235A may be disposed upstream of the dehydration reactors 205A, 205B and a second logic-controlled valve 235B may be disposed downstream of the dehydration reactors 205A, 205B.

Example method 900 further comprises opening the logic-controlled valves 235A, 235B in the absence of a second bio-alcohol, thereby providing the first bio-alcohol to the second dehydration reactor in step 910. For example, when a second bio-alcohol is not fed into the second dehydration reactor, the logic-controlled valves 235A, 235B are configured to open. Opening of the logic-controlled valve 235A upstream of the dehydration reactors 205A, 205B allows the first bio-alcohol (e.g., bioisobutanol) to flow into the second dehydration reactor 205B, thereby enabling parallel dehydration of the first bio-alcohol in each of the dehydration reactors 205A, 205B. Accordingly, example method 900 further comprises dehydrating, in parallel, at least a portion of the first bio-alcohol feed stream to an alkene process stream in the first dehydration reactor and the second dehydration reactor in step 915.

Opening of the valve 235B (e.g., logic-controlled valve) downstream of the dehydration reactors 205A, 205B allows the product (e.g., isobutylene) of the dehydration reactions from each of the dehydration reactors 205A, 205B to flow out of the dehydration reactors 205A, 205B and into an oligomerization reactor (e.g., oligomerization reactor 220). The dimerization reactor 215 of system 200 is inaccessible to the flow scheme when the valve 235B (e.g., logic-controlled valve) is opened. Accordingly, example method 900 further comprises providing the alkene process stream to an oligomerization reactor in step 920 and oligomerizing at least a portion of the alkene process stream to produce an olefin process stream as depicted in step 925. The oligomerization steps of method 900 are similar to and incorporate the disclosure of method 600 with reference to system 200.

Example method 900 further comprises providing the olefin process stream to a distillation apparatus, such as a dual wall fractionator, as depicted in step 930. For example, in some embodiments, the olefin process stream exiting the oligomerization reactor 220 may be fed into the dual wall fractionator 225 of system 200. Example method 900 further comprises separating, via distillation, lighter olefins from longer carbon chain olefins in the received olefin process stream, as depicted in step 935. With continued reference to FIG. 9, method 900 includes withdrawing a lighter olefin process stream comprising the separated lighter olefins as depicted in step 940. For example, step 940 may comprise withdrawing an overhead stream from the top of the dual-wall fractionator 225, wherein the overhead stream comprises separated lighter olefins. Method 900 may optionally further include recycling the withdrawn lighter olefin process stream into the oligomerization reactor (e.g., oligomerization reactor 220) as depicted in step 945. The distillation steps of method 900 are similar to and incorporate the disclosure of method 700 with reference to system 200.

Example method 900 may include providing the heavier olefin process stream comprising olefins to a hydrogenation reactor and hydrogenating at least a portion of the heavier olefin process stream to produce a product stream comprising diesel fuel-range compatible hydrocarbons as depicted in step 950. The hydrogenation steps of method 900 are similar to and incorporate the disclosure of method 800 with reference to system 200.

Turning to FIG. 10, the dehydration portion of method 1000 is similar to method 300 in that dehydration reaction conditions are preferably controlled in the reaction(s) in order to achieve the desired conversion and/or selectivity in accordance with the present disclosure. By way of example, but not by way of limitation, controlling or regulating any one or more of the following process parameters may achieve the desired conversion and/or selectivity: the temperature of the reaction, the flow rate of the reactants (e.g., incoming process stream(s)), the presence of a dehydration catalyst, the amount of catalyst present in the reaction vessel(s), the shape and size of the reaction vessel(s), the pressure of the reaction(s), and any combination(s) of these and other process parameters which will be available and known to those skilled in the art in view of the disclosure contained herein.

With reference to FIG. 10, in some example embodiments, example method 1000 comprises providing a first bio-alcohol feed stream comprising a first bio-alcohol to a first dehydration reactor, as depicted in step 1005. For example, the first bio-alcohol feed stream may comprise bioisobutanol. In certain embodiments, the first bio-alcohol feed stream comprises 100% bioisobutanol. As depicted in system 200 in FIG. 2, a first logic-controlled valve 235A may be disposed upstream of the dehydration reactors 205A, 205B and a second logic-controlled valve 235B may be disposed downstream of the dehydration reactors 205A, 205B.

With continued reference to FIG. 10, in some example embodiments, example method 1000 comprises providing a second bio-alcohol feed stream comprising a second bio-alcohol to a second dehydration reactor, as depicted in step 1010. For example, the second bio-alcohol feed stream may comprise bioethanol. In certain embodiments, the first bio-alcohol feed stream comprises 100% bioisobutanol and the second bio-alcohol feed stream comprises 100% bioethanol, and a sum of the bio-alcohol feed streams is 50-99% bioisobutanol and 50-1% bioethanol.

As depicted in system 200 in FIG. 2, a first logic-controlled valve 235A may be disposed upstream of the dehydration reactors 205A, 205B and a second logic-controlled valve 235B may be disposed downstream of the dehydration reactors 205A, 205B. The logic-controlled valve 235A, 235B are configured to remain closed in an instance wherein two or more bio-alcohols are used as feedstock, thereby keeping the first bio-alcohol separate from the second bio-alcohol and conducting the dehydration reactions in isolation. Accordingly, with continued reference to FIG. 10, example method 1000 comprises dehydrating, in parallel, at least a portion of the first bio-alcohol feed stream to a first alkene process stream in the first dehydration reactor and at least a portion of the second bio-alcohol feed stream to a second alkene process stream in the second dehydration reactor in step 1015.

Method 1000 further comprises providing the first alkene process stream (e.g., isobutylene as the product of the dehydration of bioisobutanol) from the first dehydration reactor 205A to an oligomerization reactor (e.g., oligomerization reactor 220) and oligomerizing at least a portion of the first alkene process stream to produce a first olefin process stream as depicted in step 1020. The oligomerization steps of method 1000 are similar to and incorporate the disclosure of method 600 with reference to system 200.

With the logic-controlled valves 235A, 235B configured to remain closed in the presence of two different bio-alcohol feedstocks, the dimerization reactor 215 of system 200 is accessible to and configured to receive the dehydration product from the second dehydration reactor. That is, method 1000 comprises providing the second alkene process stream from the second dehydration reactor 205B to a dimerization reactor 215 and dimerizing at least a portion of the second alkene process stream to produce a second olefin process stream (e.g., comprising butylene ($C_4H_8$) or other C4 or greater-olefins (e.g., C4-C8 olefins)) as depicted in step 1025. The dimerization steps of method 1000 are similar to and incorporate the disclosure of method 500 with reference to system 200.

Example method 1000 further comprises providing the first and second olefin process streams to a distillation apparatus, such as a dual wall fractionator, as depicted in step 1030. For example, in some embodiments, the olefin process streams exiting the dimerization reactor 215 and the oligomerization reactor 220 may be fed into the dual wall fractionator 225 of system 200.

Example method 1000 further comprises separating, via distillation, lighter olefins from longer carbon chain olefins in the received olefin process streams, as depicted in step 1035. With continued reference to FIG. 10, method 1000 includes withdrawing a lighter olefin process stream comprising the separated lighter olefins as depicted in step 1040. For example, step 1040 may comprise withdrawing an overhead stream from the top of the dual-wall fractionator 225, wherein the overhead stream comprises separated lighter olefins. Method 1000 may optionally further include recycling the withdrawn lighter olefin process stream into the oligomerization reactor (e.g., oligomerization reactor 220) as depicted in step 1045. The distillation steps of method 1000 are similar to and incorporate the disclosure of method 700 with reference to system 200.

Example method 1000 may include providing the heavier olefin process stream comprising olefins to a hydrogenation reactor and hydrogenating at least a portion of the heavier olefin process stream to produce a product stream comprising diesel fuel-range compatible hydrocarbons as depicted in step 1050. The hydrogenation steps of method 1000 are similar to and incorporate the disclosure of method 800 with reference to system 200.

Thus, particular embodiments of the subject matter have been described. While this specification contains many specific implementation details, these should not be construed as limitations on the scope of any inventions or of what may be claimed, but rather as description of features specific to particular embodiments of the disclosure. Other embodiments are within the scope of the following claims. Certain features that are described herein in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations or steps are depicted in the drawings in a particular order, this should not be understood as requiring that such operations or steps may be performed in the particular order shown or in sequential order, or that all illustrated operations or steps be performed, to achieve desirable results, unless described otherwise. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products. Any operational step shown in broken lines in one or more flow diagrams illustrated herein are optional for purposes of the depicted embodiment.

In some cases, the actions recited in the claims can be performed in a different order and still achieve desirable results. In addition, the processes depicted in the accompanying figures do not necessarily require the particular order shown, or sequential order, to achieve desirable results, unless described otherwise. In certain implementations, multitasking and parallel processing may be advantageous.

Overview of Terms

The following explanations of terms are provided to better describe the present disclosure and to guide those of ordinary skill in the art in the practice of the present disclosure.

As used herein, the term "comprising" means including but not limited to and should be interpreted in the manner it is typically used in the patent context. Use of broader terms such as comprises, includes, and having should be understood to provide support for narrower terms such as consisting of, consisting essentially of, and comprised substantially of.

As used herein, the phrases "in one embodiment," "according to one embodiment," "in some embodiments," and the like generally refer to the fact that the particular feature, structure, or characteristic following the phrase may be included in at least one embodiment of the present disclosure. Thus, the particular feature, structure, or characteristic may be included in more than one embodiment of the present disclosure such that these phrases do not necessarily refer to the same embodiment.

As used herein, the terms "illustrative," "example," "exemplary" and the like are used to mean "serving as an example, instance, or illustration" with no indication of quality level. Any implementation described herein as "exemplary" or "example" is not necessarily to be construed as preferred or advantageous over other implementations.

The terms "about," "approximately," "generally," "substantially," or the like, when used with a number, may mean that specific number, or alternatively, a range in proximity to the specific number, as understood by persons of skill in the art field and may be used to refer to within manufacturing and/or engineering design tolerances for the corresponding materials and/or elements as would be understood by the person of ordinary skill in the art, unless otherwise indicated.

If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

It is understood that where a parameter range is provided, all integers and ranges within that range, and tenths and hundredths thereof, are also provided by the embodiments. For example, "5-10%" includes 5%, 6%, 7%, 8%, 9%, and 10%; 5.0%, 5.1%, 5.2% . . . 9.8%, 9.9%, and 10.0%; and 5.00%, 5.01%, 5.02% . . . 9.98%, 9.99%, and 10.00%, as well as, for example, 6-9%, 5.1%-9.9%, and 5.01%-9.99%. Similarly, if the specification presents a list, unless stated otherwise, it is to be understood that each individual element of that list, and every combination of components of that list, is a separate embodiment. For example, "1, 2, 3, 4, and 5" encompasses, among numerous embodiments, 1; 2; 3; 1 and 2; 3 and 5; 1, 3, and 5; and 1, 2, 4, and 5.

The term "plurality" refers to two or more items.

The term "set" refers to a collection of one or more items.

The term "or" is used herein in both the alternative and conjunctive sense, unless otherwise indicated.

Unless explained otherwise, all technical and scientific terms used herein have the same meaning as commonly understood to one of ordinary skill in the art to which this disclosure belongs. Although methods and materials similar or equivalent to those described herein can be used in the practice or testing of the present disclosure, suitable methods and materials are described herein. The materials, methods, and examples are illustrative only and not intended to be limiting, unless otherwise indicated. Other features of the disclosure are apparent from the detailed description and the claims.

While the present disclosure has been particularly described in conjunction with specific examples, it is evident that many alternatives, modifications, and variations will be apparent to those skilled in the art in light of the foregoing description. It is therefore contemplated that the appended claims will embrace any such alternatives, modifications, and variations as falling.

CONCLUSION

Many modifications and other embodiments of the present disclosure set forth herein will come to mind to one skilled in the art to which the present disclosure pertains having the benefit of the teachings presented in the foregoing descriptions and the associated drawings. Therefore, it is to be understood that the present disclosure is not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

The invention claimed is:

1. A system configured to convert bioalcohol to renewable diesel fuel, the system comprising:

a first dehydration reactor;

a dimerization reactor;

an oligomerization reactor;

a dual wall fractionator; and a hydrogenation reactor, wherein the dual wall fractionator is configured to:

receive a first olefin process stream from the oligomerization reactor; and receive a second olefin process stream from the dimerization reactor.

2. The system of claim 1, wherein the system further comprises a low pressure splitter disposed downstream of the dehydration reactor and upstream of the dimerization reactor and the oligomerization reactor.

3. The system of claim 2, wherein the dimerization reactor and the oligomerization reactor are connected in parallel to the low pressure splitter such that the dimerization reactor is configured to receive a first process stream from the low pressure splitter and the oligomerization reactor is configured to receive a separate, second process stream from the low pressure splitter.

4. The system of claim 1, wherein the system further comprises a second dehydration reactor disposed in parallel to the first dehydration reactor.

5. The system of claim 4, wherein one or more logic-controlled valves are disposed between the first and second dehydration reactors, the one or more logic-controlled valves configured to open in the absence of two bio-alcohol feedstocks.

6. The system of claim 5, wherein the dimerization reactor is connected to the second dehydration reactor.

7. The system of claim 5, wherein the dimerization reactor is inaccessible to the first dehydration reactor.

8. The system of claim 5, wherein the one or more logic-controlled valves are configured to close in presence of two bio-alcohol feedstocks.

9. The system of claim 8, wherein the dual wall fractionator is configured to:

receive the first olefin process stream from the oligomerization reactor; and receive the second olefin process stream from the dimerization reactor in an instance wherein the one or more logic-controlled valves are closed.

* * * * *